US011319839B2

(12) United States Patent
Prenter et al.

(10) Patent No.: US 11,319,839 B2
(45) Date of Patent: May 3, 2022

(54) COMPONENT HAVING A DIRT TOLERANT PASSAGE TURN

(71) Applicant: United Technologies Corporation, Farmington, CT (US)

(72) Inventors: Robin Prenter, Avon, CT (US); Timothy J. Jennings, New Britain, CT (US); Carey Clum, East Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/722,226

(22) Filed: Dec. 20, 2019

(65) Prior Publication Data

US 2021/0189911 A1 Jun. 24, 2021

(51) Int. Cl.

*F01D 25/32* (2006.01)
*F01D 5/18* (2006.01)
*F01D 9/06* (2006.01)

(52) U.S. Cl.

CPC ..... *F01D 25/32* (2013.01); *F01D 5/187* (2013.01); *F01D 5/188* (2013.01); *F01D 5/186* (2013.01); *F01D 9/065* (2013.01); *F05D 2240/126* (2013.01); *F05D 2250/185* (2013.01); *F05D 2260/22141* (2013.01); *F05D 2260/607* (2013.01)

(58) Field of Classification Search

CPC ..... F01D 5/186; F01D 5/187; F01D 5/188; F01D 9/065; F01D 21/10; F01D 25/32; F05D 2240/126; F05D 2240/127; F05D 2250/185; F05D 2260/20; F05D 2260/202; F05D 2260/2212; F05D 2260/22141; F05D 2260/607

See application file for complete search history.

(56) References Cited

U.S. PATENT DOCUMENTS 4,775,296 A * 10/1988 Schwarzmann ..... F01D 5/187 416/97 R
4,820,123 A 4/1989 Hall
4,992,026 A * 2/1991 Ohtomo ..... F01D 5/187 415/115
5,599,166 A * 2/1997 Deptowicz ..... B22C 9/04 164/369
7,654,795 B2 2/2010 Tibbott (Continued)

OTHER PUBLICATIONS

EP search report for EP20212941.7 dated May 10, 2021.

*Primary Examiner* — Christopher Verdier
(74) *Attorney, Agent, or Firm* — Getz Balich LLC

(57) ABSTRACT

A component includes a component body. The component further includes a first passage disposed in the component body. The first passage includes a first end and a second end opposite the first end. The component further includes a second passage. The second passage extends from the second end of the first passage. The second passage includes a turn. The component further includes a third passage. The third passage extends from the second end of the first passage. The component further includes a first projection extending from a passage surface of the component body within the first passage. The first projection is disposed between the first and the second end of the first passage and is configured to direct debris transiting the first passage away from the second passage and into the third passage.

17 Claims, 7 Drawing Sheets

(56) References Cited

U.S. PATENT DOCUMENTS

| | | | | |
|---|---|---|---|---|
| 7,665,965 | B1 | 2/2010 | Liang | |
| 9,279,331 | B2 | 3/2016 | Levine | |
| 2002/0176776 | A1 | 11/2002 | Parneix | |
| 2009/0155088 | A1 | 6/2009 | Lee | |
| 2013/0343872 | A1* | 12/2013 | Tibbott | F01D 9/06 415/115 |
| 2016/0341046 | A1 | 11/2016 | Feldmann | |

* cited by examiner

COMPONENT HAVING A DIRT TOLERANT PASSAGE TURN

BACKGROUND

1. Technical Field

This disclosure relates generally to components for gas turbine engines, and more particularly to purging debris particles from said components.

2. Background Information

Components for gas turbine engines (e.g., airfoils) may typically include complex internal cooling passages receiving a cooling fluid from a cooling source. The cooling fluid transiting the cooling passages may include dirt, debris, or other particulate entrained therein. In some cases, debris particles may impact the walls of the internal cooling passages and potentially become deposited on the walls. Over time, accumulation of debris particles on the walls of the cooling passages may result in degradation of component performance. Accordingly, what is needed is systems and/or methods addressing one or more of the above-noted concerns.

SUMMARY

It should be understood that any or all of the features or embodiments described herein can be used or combined in any combination with each and every other feature or embodiment described herein unless expressly noted otherwise.

According to an embodiment of the present disclosure a component includes a component body. The component further includes a first passage disposed in the component body. The first passage includes a first end and a second end opposite the first end. The component further includes a second passage. The second passage extends from the second end of the first passage. The second passage includes a turn. The component further includes a third passage. The third passage extends from the second end of the first passage. The component further includes a first projection extending from a passage surface of the component body within the first passage. The first projection is disposed between the first and the second end of the first passage and is configured to direct debris transiting the first passage away from the second passage and into the third passage.

In the alternative or additionally thereto, in the foregoing embodiment, the turn includes a radius, and a height of the first projection from the passage surface is between 10 percent of the radius and 50 percent of a diameter of the first passage.

In the alternative or additionally thereto, in the foregoing embodiment, the height of the first projection is between 15 and 25 percent of the radius.

In the alternative or additionally thereto, in the foregoing embodiment, the first passage further includes a first side and a second side opposite the first side. The first side and the second side extend between the first end and the second end of the first passage. The second passage extends from the first passage on the first side and the third passage extends from the first passage on the second side.

In the alternative or additionally thereto, in the foregoing embodiment, the first projection extends from the passage surface on the first side of the first passage.

In the alternative or additionally thereto, in the foregoing embodiment, the component further includes a second projection extending from the component body at the second end of the first passage. The second projection extends in a first direction from the second end of the first passage to the first end of the first passage and is disposed between the second passage and the third passage.

In the alternative or additionally thereto, in the foregoing embodiment, a distance between the first projection and the second projection in the first direction from the second end of the first passage to the first end of the first passage is greater than or equal to 10 percent of the radius.

In the alternative or additionally thereto, in the foregoing embodiment, the third passage includes a dirt purge outlet extending between the third passage and an exterior of the component. The dirt purge outlet extends in a second direction and the third passage extends in a third direction, different than the second direction.

In the alternative or additionally thereto, in the foregoing embodiment, the component is an airfoil.

In the alternative or additionally thereto, in the foregoing embodiment, the radius of the turn is an average radius along the extent of the turn.

In the alternative or additionally thereto, in the foregoing embodiment, a distal end of the second projection is disposed upstream of the turn with respect to the first direction.

In the alternative or additionally thereto, in the foregoing embodiment, the component body includes at least one heat augmentation feature disposed within the first passage.

According to another embodiment of the present disclosure, a method for purging dirt from a component includes providing a component body including a first passage disposed in the component body. The first passage includes a first end and a second end opposite the first end. The component body further includes a second passage extending from the second end of the first passage and a third passage extending from the second end of the first passage. The second passage includes a turn. The method further includes directing debris transiting the first passage away from the second passage and into the third passage with a first projection extending from a passage surface of the component body within the first passage. The first projection is disposed between the first end and the second end of the first passage.

In the alternative or additionally thereto, in the foregoing embodiment, the turn includes a radius, and a height of the first projection from the passage surface is between 10 percent of the radius and 50 percent of a diameter of the first passage.

In the alternative or additionally thereto, in the foregoing embodiment, the height of the first projection is between 15 and 25 percent of the radius.

In the alternative or additionally thereto, in the foregoing embodiment, the component body further includes a second projection extending from the component body at the second end of the first passage. The second projection extends in a first direction from the second end of the first passage to the first end of the first passage and is disposed between the second passage and the third passage.

In the alternative or additionally thereto, in the foregoing embodiment, the third passage includes a dirt purge outlet extending between the third passage and an exterior of the component. The dirt purge outlet extends in a second direction and the third passage extends in a third direction, different than the second direction.

In the alternative or additionally thereto, in the foregoing embodiment, a distance between the first projection and the second projection in the first direction from the second end of the first passage to the first end of the first passage is greater than or equal to 10 percent of the radius.

In the alternative or additionally thereto, in the foregoing embodiment, the radius of the turn is an average radius along the extent of the turn.

According to another embodiment of the present disclosure, a component for a gas turbine engine includes a component body. The component further includes a first passage disposed in the component body. The first passage includes a first end and a second end opposite the first end. The component further includes a second passage extending from the second end of the first passage. The second passage includes a turn. The component further includes a third passage extending from the second end of the first passage. The component further includes a first projection extending from a passage surface of the component body within the first passage. The first projection is disposed between the first end and the second end of the first passage and is configured to direct debris transiting the first passage away from the second passage and into the third passage. The turn includes a radius, and a height of the first projection from the passage surface is between 10 percent of the radius and 50 percent of a diameter of the first passage. The component further includes a second projection extending from the component body at the second end of the first passage. The second projection is disposed between the second passage and the third passage.

The present disclosure, and all its aspects, embodiments and advantages associated therewith will become more readily apparent in view of the detailed description provided below, including the accompanying drawings.

DETAILED DESCRIPTION

Figure 1:
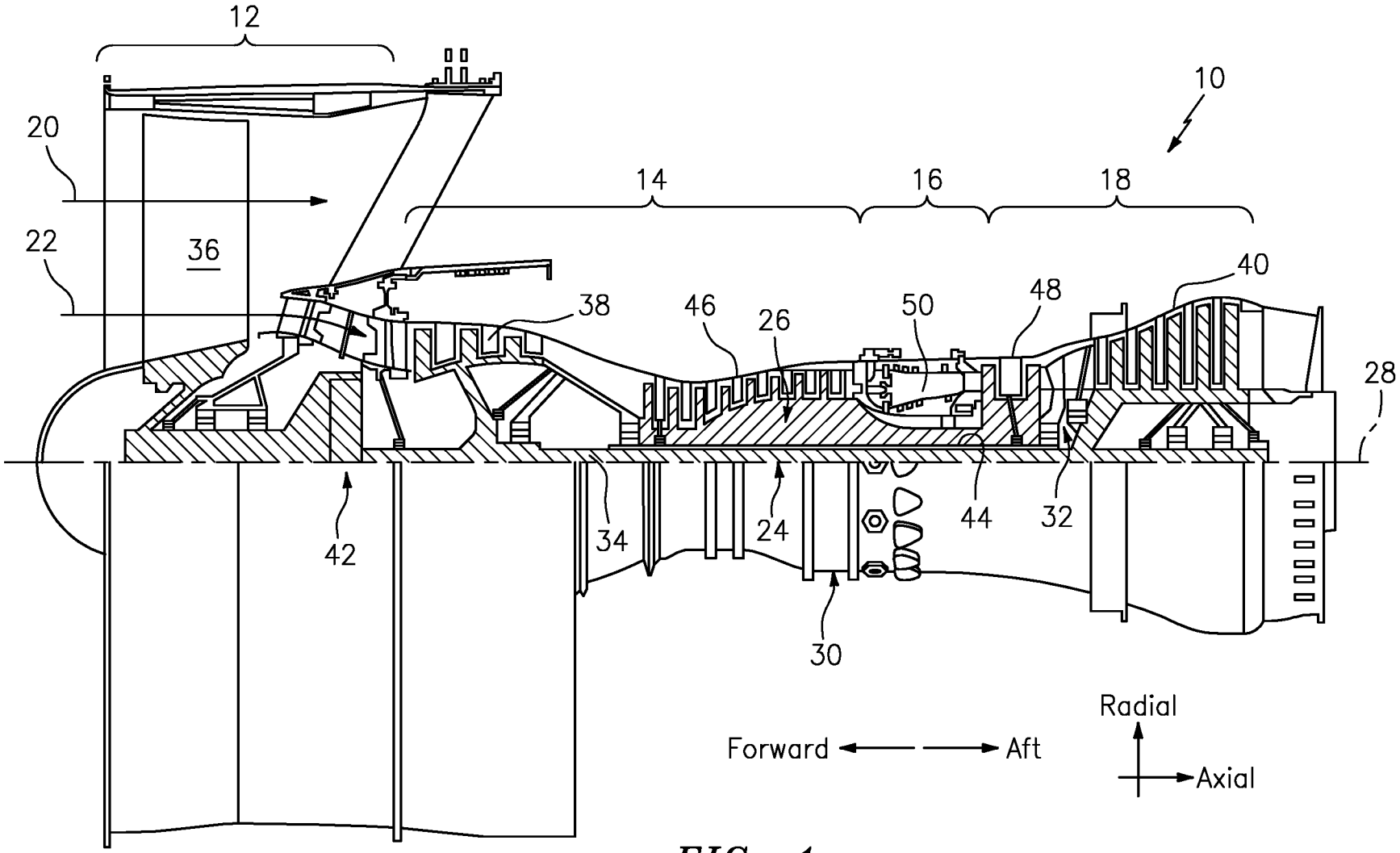
FIG. 1 illustrates a side cross-sectional view of a gas turbine engine in accordance with one or more embodiments of the present disclosure.

It is noted that various connections are set forth between elements in the following description and in the drawings. It is noted that these connections are general and, unless specified otherwise, may be direct or indirect and that this specification is not intended to be limiting in this respect. A coupling between two or more entities may refer to a direct connection or an indirect connection. An indirect connection may incorporate one or more intervening entities. It is further noted that various method or process steps for embodiments of the present disclosure are described in the following description and drawings. The description may present the method and/or process steps as a particular sequence. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the description should not be construed as a limitation.

Referring to FIG. 1, an exemplary gas turbine engine 10 is schematically illustrated. The gas turbine engine 10 is disclosed herein as a two-spool turbofan engine that generally includes a fan section 12, a compressor section 14, a combustor section 16, and a turbine section 18. The fan section 12 drives air along a bypass flowpath 20 while the compressor section 14 drives air along a core flowpath 22 for compression and communication into the combustor section 16 and then expansion through the turbine section 18. Although depicted as a turbofan gas turbine engine in the disclosed non-limiting embodiments, it should be understood that the concepts described herein are not limited to use with turbofans as the teachings may be applied to other types of turbine engines including those with three-spool architectures.

The gas turbine engine 10 generally includes a low-pressure spool 24 and a high-pressure spool 26 mounted for rotation about a longitudinal centerline 28 of the gas turbine engine 10 relative to an engine static structure 30 via one or more bearing systems 32. It should be understood that various bearing systems 32 at various locations may alternatively or additionally be provided.

The low-pressure spool 24 generally includes a first shaft 34 that interconnects a fan 36, a low-pressure compressor 38, and a low-pressure turbine 40. The first shaft 34 is connected to the fan 36 through a gear assembly of a fan drive gear system 42 to drive the fan 36 at a lower speed than the low-pressure spool 24. The high-pressure spool 26 generally includes a second shaft 44 that interconnects a high-pressure compressor 46 and a high-pressure turbine 48. It is to be understood that "low pressure" and "high pressure" or variations thereof as used herein are relative terms indicating that the high pressure is greater than the low pressure. An annular combustor 50 is disposed between the high-pressure compressor 46 and the high-pressure turbine 48 along the longitudinal centerline 28. The first shaft 34 and the second shaft 44 are concentric and rotate via the one or more bearing systems 32 about the longitudinal centerline 28 which is collinear with respective longitudinal centerlines of the first and second shafts 34, 44.

Airflow along the core flowpath 22 is compressed by the low-pressure compressor 38, then the high-pressure compressor 46, mixed and burned with fuel in the combustor 50, and then expanded over the high-pressure turbine 48 and the low-pressure turbine 40. The low-pressure turbine 40 and the high-pressure turbine 48 rotationally drive the low-pressure spool 24 and the high-pressure spool 26, respectively, in response to the expansion.

Figure 2:
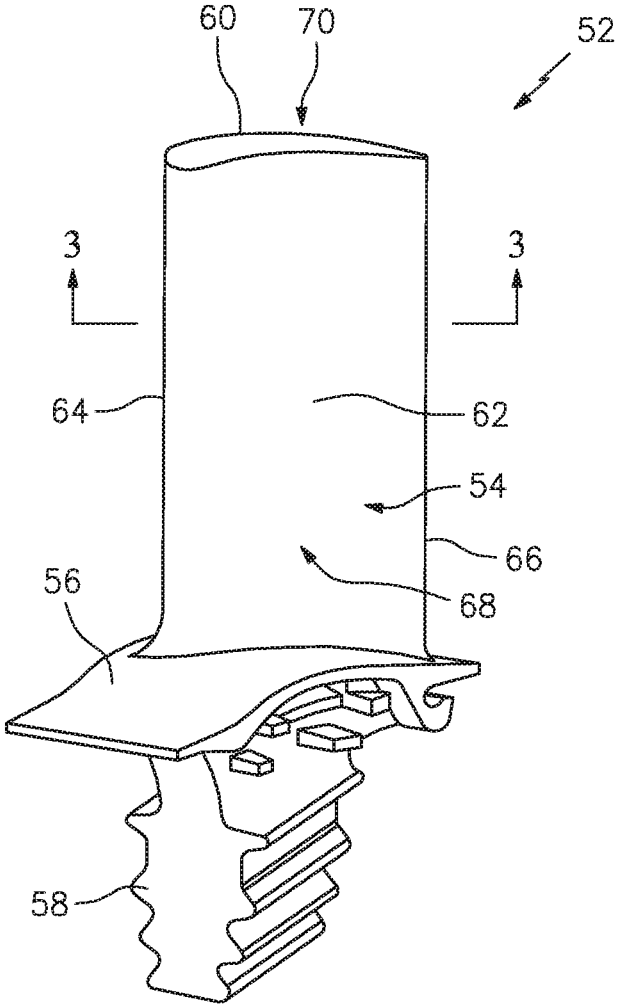
FIG. 2 illustrates a perspective view of an exemplary airfoil of the gas turbine engine of FIG. 1 in accordance with one or more embodiments of the present disclosure.
Figure 3:
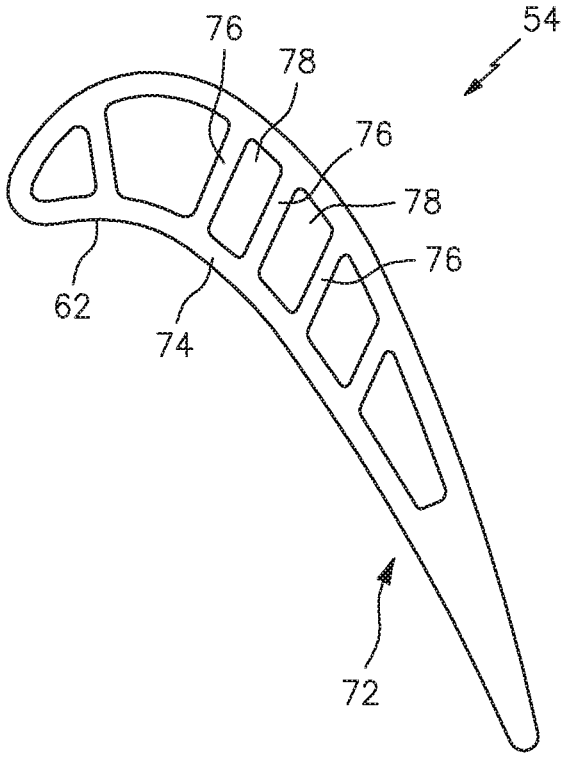
FIG. 3 illustrates a cross-sectional view of the exemplary airfoil of FIG. 2 taken along line 3-3 in accordance with one or more embodiments of the present disclosure.

Referring to FIGS. 2 and 3, one or both of the compressor section 14 and the turbine section 18 may include, for example, alternating rows of blades 52 and static airfoils or vanes. FIG. 2 illustrates a blade 52 including an exemplary airfoil 54 which may form a portion of one or more of the blades 52 or vanes of the gas turbine engine 10. The blade 52 includes a platform 56 supported by a root 58 which may be secured to, for example, a rotor. The airfoil 54 extends radially from the platform 56, opposite the root 58, to a tip 60. The airfoil 54 includes an exterior surface 62 extending between a leading edge 64 and a trailing edge 66 and defining a pressure side 68 and opposite suction side 70 of the airfoil 54. While the airfoil 54 is illustrated as being part of a blade 52, it should be understood that the disclosed airfoil 54 can also be used as a vane.

As shown in FIG. 3, the airfoil 54 includes an airfoil body 72 defining a perimeter wall 74 of the airfoil 54. The airfoil body 72 may further define one or more ribs 76 extending between and connecting opposing portions of the perimeter wall 74. The perimeter wall 74 and ribs 76 of the airfoil body 72 may define one or more passages 78 (e.g., cooling air or fluid passages) disposed in the airfoil body 72. In various embodiments, the airfoil body 72 may include film cooling holes or other apertures extending through the airfoil body 72 between the passages 78 and an exterior of the airfoil 54.

Figure 4:
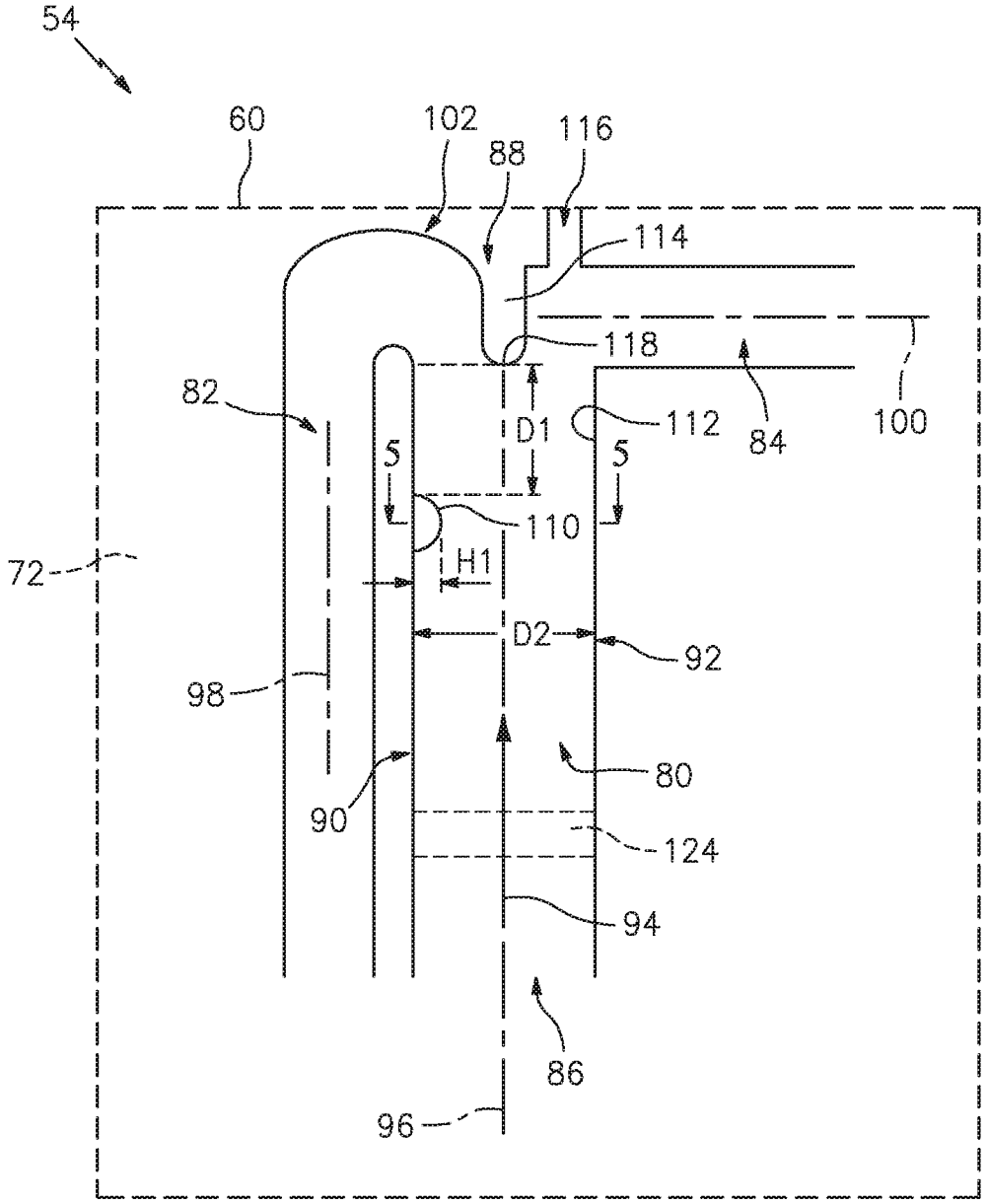
FIG. 4 illustrates a side view of a portion of the airfoil of FIG. 2 in accordance with one or more embodiments of the present disclosure.

Referring to FIGS. 4-7, the one or more passages 78 disposed in the airfoil body 72 may include, a series of interconnected passages, for example, a first passage 80, a second passage 82, and a third passage 84 defined by a passage surface 112 of the airfoil body 72. The first passage 80 includes a first end 86 and a second end 88 opposite the first end 86. The first passage 80 further includes a first side 90 and a second side 92 opposite the first side. The first side 90 and the second side 92 extend between the first end 86 and the second end 88 of the first passage 80. In the illustrated embodiment, the second passage 82 extends from the second end 88 of the first passage 80 on the first side 90 while the third passage 84 extends from the second end 88 of the first passage 80 on the second side 92. The third passage 84 may be a tip flag cavity of the airfoil 54. As shown in FIG. 4, cooling air flow 94 transiting the first passage 80 may flow generally in a direction from the first end 86 to the second end 88 of the first passage 80 and subsequently into the second and third passages 82, 84. The cooling air flow 94 may include dirt, debris, and other particulate material entrained therein.

The first passage 80 may extend along a first passage center axis 96 extending generally in a direction between the first end 86 and the second end 88 of the first passage 80. In various embodiments, the first passage center axis 96 may be substantially radially oriented relative to the longitudinal centerline 28 of the gas turbine engine 10. The second and third passages 82, 84 may include respective second and third passage center axes 98, 100 along which they extend. In various embodiments, the second passage center axis 98 may be substantially parallel to the first passage center axis 96. In various embodiments, the third passage center axis 100 may be substantially perpendicular to the first passage center axis 96. However, it should be understood that the passages 80, 82, 84 may be oriented in any suitable direction relative to one another and are not limited to the exemplary description of the passage center axes 96, 98, 100 discussed above. For example, airfoils may typically be curved, therefore, the passages therein may also be curved consistent with the shape of the airfoil. Further, the diameter of the passages 80, 82, 84 may vary along the length of the passages 80, 82, 84. As used here, the term "substantially," used in connection with an angular reference should be understood to mean a range of angles within five degrees of the stated angular orientation.

The second passage 82 may include a turn 102 such as, for example, a serpentine turn as shown in FIG. 4. In various embodiments, the turn 102 may be located at an interface between the first passage 80 and the second passage 82 (e.g., at the second end 88 of the first passage 80). The turn 102 includes a radius which may be, for example, an average radius along the extent of the turn 102. While the present disclosure will be explained with respect to the airfoil 54, it should be understood that the concepts described herein may be applied to any component having fluid passages including a turn, for example, a component for a gas turbine engine having two passages connected by a turn (e.g., a blade outer air seal, an air-cooled combustor assembly component, etc.).

Figure 5:
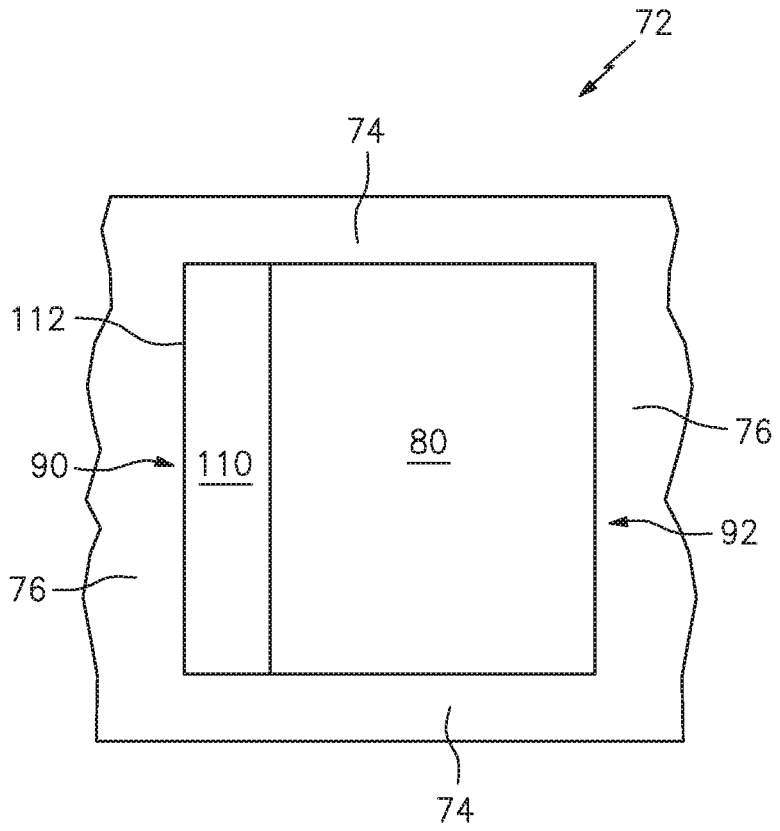
FIG. 5 illustrates a cross-sectional view of the portion of the airfoil of FIG. 3 taken along line 5-5 in accordance with one or more embodiments of the present disclosure.

The airfoil 54 includes a first projection 110 extending from the passage surface 112 of the airfoil body 72 within the first passage 80 and configured to direct debris transiting the first passage 80 away from the second passage 82 and into the third passage 84. The first projection 110 has a height H1 extending from the passage surface 112 into the first passage 80. The first projection 110 may extend from the passage surface 112 on a side 90, 92 of the first passage 80 which corresponds to the location of the turn 102. For example, as shown in FIG. 4, the turn 102 of the second passage 82 and the first projection 110 are disposed on the first side 90 of the first passage 80. As shown in FIG. 5, the first projection 110 may, for example, extend between and connect opposing portions of the perimeter wall 74 of the airfoil body 72, however, the first projection 110 may have any suitable orientation with respect to portions of the airfoil body 72. Further, the first projection 110 may have various shapes and should not be understood as being limited to the exemplary shape depicted in FIGS. 4, 6, and 7. For example, the first projection 110 may be shaped as a ramp (e.g., having a height from the passages surface 112 which gradually increases in a direction from the first end 86 to the second end 88 of the first passage 80) or any other suitable shape for guiding the cooling air flow 94 in the desired direction. In various other embodiments, the first projection 110 may extend only a portion of a distance across the first passage 80. While the first passage 80 of FIG. 5 is shown as having a generally square cross-sectional shape, it should be understood that the first passage 80 or other passages of the one or more passages 78 can have any suitable cross-sectional shape.

In various embodiments, the airfoil 54 may include a second projection 114 extending from the airfoil body 72 at the second end 88 of the first passage 80. The second projection 114 may be configured to guide debris directed away from the second passage 82, by the first projection 110, into the third passage 84. The second projection 114 may generally extend in a direction from the second end 88 of the first passage 80 toward the first end 86 of the first passage 80. The second projection 114 may be disposed between the second passage 82 and the third passage 84 and may define a portion of the turn 102 of the second passage 82. The first projection 110 and the second projection 114 may be separated by a distance D1 with respect to the first passage center axis 96. In various embodiments, a distal end 118 of the second projection 114 may be disposed at or upstream of the turn 102 of the second passage 82 with respect to the first passage center axis 96 and the direction of the cooling air flow 94.

In various embodiments, the third passage 84 may include a dirt purge outlet 116 extending through the airfoil body 72 between the third passage 84 and an exterior of the airfoil 54. Debris directed by the first and second projections 110, 114 into the third passage 84 may pass out of the airfoil 54 through the dirt purge outlet 116. In various embodiments, the dirt purge outlet 116 may extend in a direction different than the third passage center axis 100 of the third passage 84.

For example, in various embodiments, the dirt purge outlet 116 may extend in a direction substantially parallel to the first passage center axis 96.

Debris impacting the passage surface 112 at turns (e.g., turn 102) can result in significant debris accumulation along the passage surface 112 potentially resulting in accelerated distress of the airfoil 54 and undesirable corrective maintenance. One factor affecting the degree of debris accumulation is debris particle size. Debris enters the cooling passages 78 of the airfoil 54 with a distribution of sizes and the larger debris particles may be less likely to follow the flow field of the cooling air flow 94 for the entire transit of the turn 102. These larger debris particles may strike the passage surface 112 potentially resulting in deposition along the passage surface 112. The propensity for a debris particle to follow or deviate from the direction of the cooling air flow 94 may be estimated by the debris particle's Stokes number (St). St>>1 may indicate that a debris particle will follow its own trajectory while a debris particle with St<<1 may tend to follow the flow field of the cooling air flow 94. Accordingly, the height H1 of the first projection 110 may be determined with respect to the radius of the turn 102 in order to minimize or prevent debris particles having St>>1, with respect to the turn 102, from entering the turn 102 using, for example, a formula:

$$St = \frac{\rho_p d^2 U}{18 \mu_g l_0} \quad [1]$$

In formula 1, $\rho_p$ represents a density of debris particle, d represents a diameter of the debris particle, U represents a velocity of the debris particle, $\mu_g$ represents a viscosity of the fluid, and $l_0$ represents a length scale (e.g., the radius of the turn 102 or the height H1).

Accordingly, in various embodiments, the height H1 of the first projection 110 may be between 10 and 50 percent of the radius of the turn 102. In various embodiments, the height H1 of the first projection 110 may be between 15 and 25 percent of the radius of the turn 102. In various embodiments, the height H1 of the first projection 110 may be 20 percent of the radius of the turn 102. In various embodiments, the height H1 of the first projection 110 may be less than or equal to 50 percent of a distance D2 between the first side 90 and the second side 92 of the first passage 80 (e.g., a diameter of the first passage 80 at the location of the first projection 110). As used herein, a range of heights or other distances are inclusive of the endpoints of the range. The height H1 of the first projection 110 may be selected such that high-risk debris particles (e.g., relatively large debris particles) having a St value>1, with respect to the first projection 110, may interact with the first projection 110 and be directed away from the turn 102. Additionally, in various embodiments, the distance D1 between the first projection 110 and the second projection 114 may be greater than or equal to 10 percent of the radius of the turn 102 (e.g., between 10 percent of the radius of the turn 102 and an entire length of the first passage 80). In various embodiments, the distance D1 between the first projection 110 and the second projection 114 may be between 40 and 200 percent of the radius of the turn 102, for example, to allow the second projection 114 to further guide the debris particles into the third passage 84. Selection of the height H1 of the first projection 110 may be selected such that the height H1 is sufficient to direct high-risk debris particles away from the turn 102 while minimizing a pressure drop of the cooling air flow 94 through the passages 78.

Figure 6:
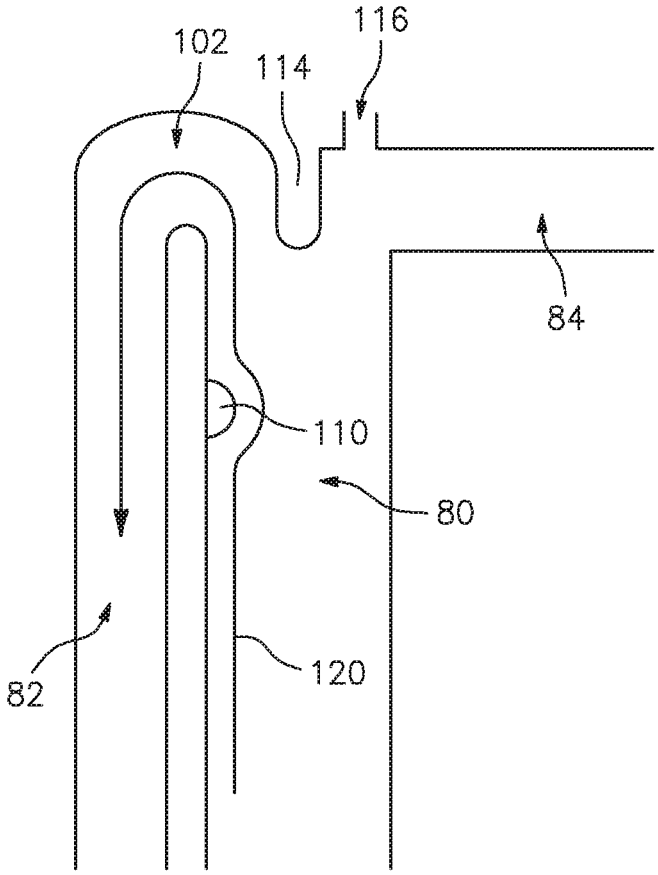
FIG. 6 illustrates a side view of a portion of the airfoil of FIG. 2 in accordance with one or more embodiments of the present disclosure.
Figure 7:
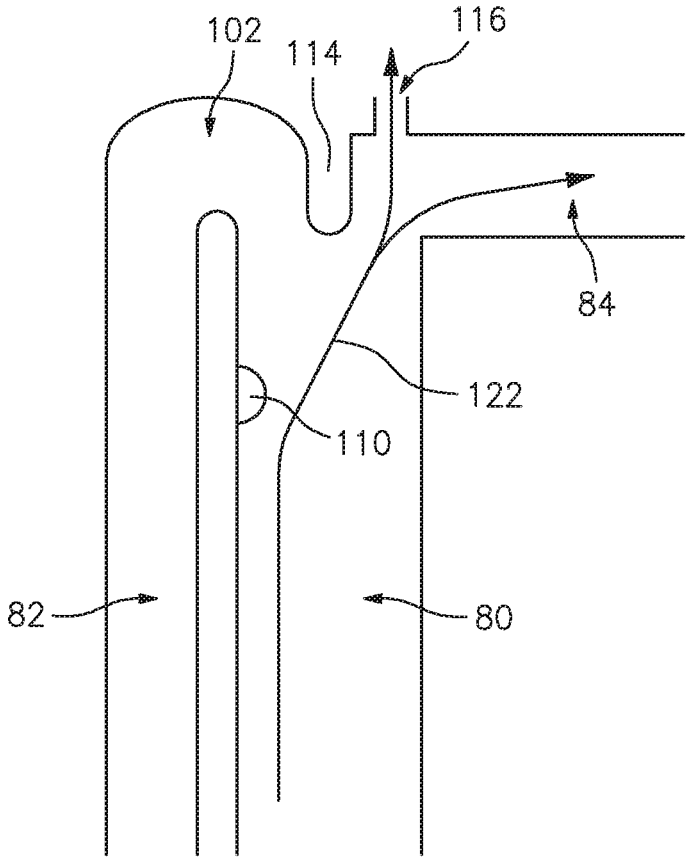
FIG. 7 illustrates a side view of a portion of the airfoil of FIG. 2 in accordance with one or more embodiments of the present disclosure.

As shown in FIGS. 6 and 7, for example, a debris particle with St<1, with respect to the turn 102, may travel along a first particle flowpath 120 into the second passage 82 (see FIG. 6) while a debris particle with St>1, with respect to the turn 102, may travel along a second particle flowpath 122 into the third passage 84 (see FIG. 7). The debris particle traveling along the second particle flowpath 122 may proceed through the third passage 84 or, alternatively, may be ejected from the airfoil 54 via the dirt purge outlet 116.

Referring again to FIG. 4, in various embodiments, the airfoil 54 may include one or more heat augmentation features 124 (e.g., trip strips, pedestals, etc.), distinct from the first and second projections 110, 114 to improve heat transfer or fluid flow within the passages 78 of the airfoil body 72.

While various aspects of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these particular features may be described individually, it is within the scope of the present disclosure that some or all of these features may be combined with any one of the aspects and remain within the scope of the present disclosure. References to "various embodiments," "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described. Accordingly, the present disclosure is not to be restricted except in light of the attached claims and their equivalents.

What is claimed is:

1. A component comprising:

a component body;

a first passage disposed in the component body, the first passage comprising a first end and a second end opposite the first end;

a second passage extending from the second end of the first passage, the second passage comprising a turn;

a third passage extending from the second end of the first passage; and a first projection extending from a passage surface of the component body within the first passage, the first projection disposed between the first end and the second end of the first passage and configured to direct debris transiting the first passage away from the second passage and into the third passage;

wherein the turn comprises a radius, wherein a height of the first projection from the passage surface is between 10 percent and 50 percent of the radius, and wherein the height of the first projection is less than or equal to 50 percent of a diameter of the first passage.

2. The component of claim 1, wherein the height of the first projection is between 15 and 25 percent of the radius.

3. The component of claim 1, wherein the first passage further comprises a first side and a second side opposite the first side, the first side and the second side extending between the first end and the second end of the first passage and wherein the second passage extends from the first passage on the first side and the third passage extends from the first passage on the second side.

4. The component of claim 3, wherein the first projection extends from the passage surface on the first side of the first passage.

5. The component of claim 4, further comprising a second projection extending from the component body at the second end of the first passage, the second projection extending in a first direction from the second end of the first passage to the first end of the first passage and disposed between the second passage and the third passage.

6. The component of claim 5, wherein a distance between the first projection and the second projection in the first direction from the second end of the first passage to the first end of the first passage is greater than or equal to 10 percent of the radius.

7. The component of claim 5, wherein the third passage comprises a dirt purge outlet extending between the third passage and an exterior of the component and wherein the dirt purge outlet extends in a second direction and the third passage extends in a third direction, different than the second direction.

8. The component of claim 5, wherein the radius of the turn is an average radius along the extent of the turn.

9. The component of claim 8, wherein a distal end of the second projection is disposed upstream of the turn with respect to the first direction.

10. The component of claim 1, wherein the component is an airfoil.

11. The component of claim 1, wherein the component body comprises at least one heat augmentation feature disposed within the first passage.

12. A method for purging dirt from a component, the method comprising:

providing a component body comprising a first passage disposed in the component body, the first passage comprising a first end and a second end opposite the first end, the component body further comprising a second passage extending from the second end of the first passage and a third passage extending from the second end of the first passage, the second passage comprising a turn; and directing debris transiting the first passage away from the second passage and into the third passage with a first projection extending from a passage surface of the component body within the first passage, the first projection disposed between the first end and the second end of the first passage;

wherein the turn comprises a radius,. and wherein a height of the first projection from the passage surface is between 10 percent and 50 percent of the radius, and wherein the height of the first projection is less than or equal to 50 percent of a diameter of the first passage.

13. The method of claim 12, wherein the height of the first projection is between 15 and 25 percent of the radius.

14. The method of claim 12, wherein the component body further comprises a second projection extending from the component body at the second end of the first passage, the second projection extending in a first direction from the second end of the first passage to the first end of the first passage and disposed between the second passage and the third passage.

15. The method of claim 14, wherein the third passage comprises a dirt purge outlet extending between the third passage and an exterior of the component and wherein the dirt purge outlet extends in a second direction and the third passage extends in a third direction, different than the second direction.

16. The method of claim 14, wherein a distance between the first projection and the second projection in the first direction from the second end of the first passage to the first end of the first passage is greater than or equal to 10 percent of the radius.

17. The method of claim 12, wherein the radius of the turn is an average radius along the extent of the turn.

* * * * *